US005297658A

United States Patent [19]

Grinaski et al.

[11] Patent Number: 5,297,658

[45] Date of Patent: Mar. 29, 1994

[54] ROLLER CAM ADJUSTER FOR LINEAR MOTORS

[75] Inventors: Timothy J. Grinaski, East Hartford; Robin M. Miller, Ellington, both of Conn.

[73] Assignee: Otis Elevator Company, Farmington, Conn.

[21] Appl. No.: 957,496

[22] Filed: Oct. 7, 1992

[51] Int. Cl.[5] ..... B66B 17/12

[52] U.S. Cl. ..... 187/94; 187/112; 310/13

[58] Field of Search ..... 187/1 R, 94, 17, 112; 310/12, 13, 14

[56] References Cited

U.S. PATENT DOCUMENTS 5,127,493 7/1992 Yasuda et al. ..... 187/112

5,203,432 4/1993 Grinaski ..... 187/112

*Primary Examiner*—D. Glenn Dayoan

*Assistant Examiner*—Kenneth Noland

[57] ABSTRACT

In an elevator system driven by a linear motor a small consistent air gap must be maintained between two elements of a linear motor for proper and efficient operation of the system. The air gap within the linear motor can be maintained and adjusted by utilizing a roller cam adjuster. The roller cam adjuster is disposed on a side of a moving portion of the linear motor and is supported by a plate with a roller disposed therein. As the roller cam adjuster is adjusted, the air gap can be either increased or decreased depending upon the need.

3 Claims, 3 Drawing Sheets

ROLLER CAM ADJUSTER FOR LINEAR MOTORS

BACKGROUND OF THE INVENTION

1. Technical Field

This invention relates to a linear motor driving an elevator, and more particularly to maintaining an air gap between primary and secondary portions thereof.

2. Background Art

A typical elevator system comprises an elevator car and a counter weight each suspended on opposite ends of a hoist rope disposed in an elevator hoistway. The elevator system also includes a linear motor generating a thrust force that facilitates movement of a counter weight. As the counter weight is alternatingly moved up and down by the linear motor the elevator car moves correspondingly thereto.

Linear motors include a rotor, frequently referred to as a secondary, and a stator, referred to as a primary. The primary or stator is typically attached to the counter weight and is engaged in linear motion, whereas the secondary or rotor is stationary and is fixedly attached to an inner wall of the hoistway.

To insure proper operation of the motor, a specified air gap must be maintained between the primary and secondary portions of the motor. The two portions of the motor are pulled together by attraction forces that exceed the thrust force of the motor. If the primary and secondary portions come in contact with each other, a short circuit may be caused. Furthermore, a small constant air gap increases efficiency as well. Thus, maintaining a constant air gap is of utmost importance. Older versions of the linear motors employ guide rails on which the primary motor was suspended, wherein these guide rails get deformed with time due to the attraction forces between the primary and secondary portions of the linear motor.

U.K. Pat. No. 2,237,555A disclosed a device for maintaining the air gap, which includes a single roller assembly and is attached to the moving primary motor. The air gap is maintained through the adjustment of two adjusting rods. However, there is still a need for more precise adjustment of the air gap and for an easier means of adjusting the air gap.

DISCLOSURE OF THE INVENTION

It is an object of the invention to maintain a proper air gap between the primary and secondary portions of a linear motor within an elevator system.

It is a further object of the invention to adjust the air gap precisely and easily.

According to the invention, an air gap is maintained and can be adjusted between two portions of a linear motor within an elevator system by utilizing a roller cam adjuster The roller cam adjuster is attached onto a roller truck disposed on a side of a moving element of the linear motor to facilitate an adjustment of the size of the air gap between the moving and stationary elements within a linear motor, wherein the roller truck assembly includes a roller supported by a plate. The roller cam adjuster can be adjusted to either increase or reduce the air gap.

Other features and advantages of the present invention will be apparent from the specification and claims and from the accompanying drawings which illustrate an embodiment of the invention.

BRIEF DESCRIPTION OF THE DRAWINGS

FIG. 3 is a top perspective view of the roller cam adjuster of FIG. 1 in accordance with the invention;

FIG. 6 is a top perspective view of another embodiment of the roller cam adjuster of FIG. 1.

BEST MODE FOR CARRYING OUT THE INVENTION

Figure 1:
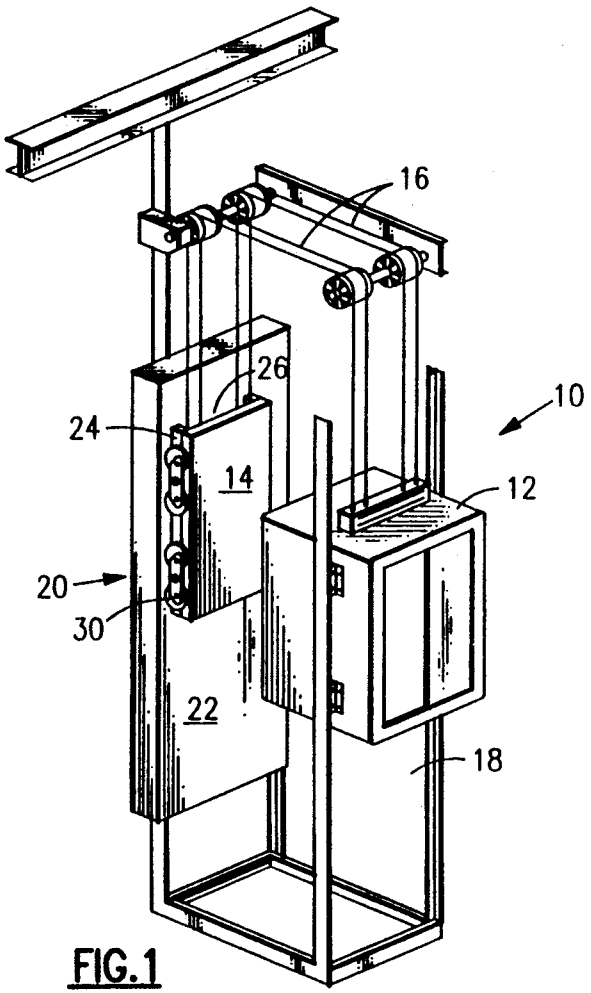
FIG. 1 is a top perspective view of an elevator assembly with a linear motor and a roller cam adjuster.
Figure 2:
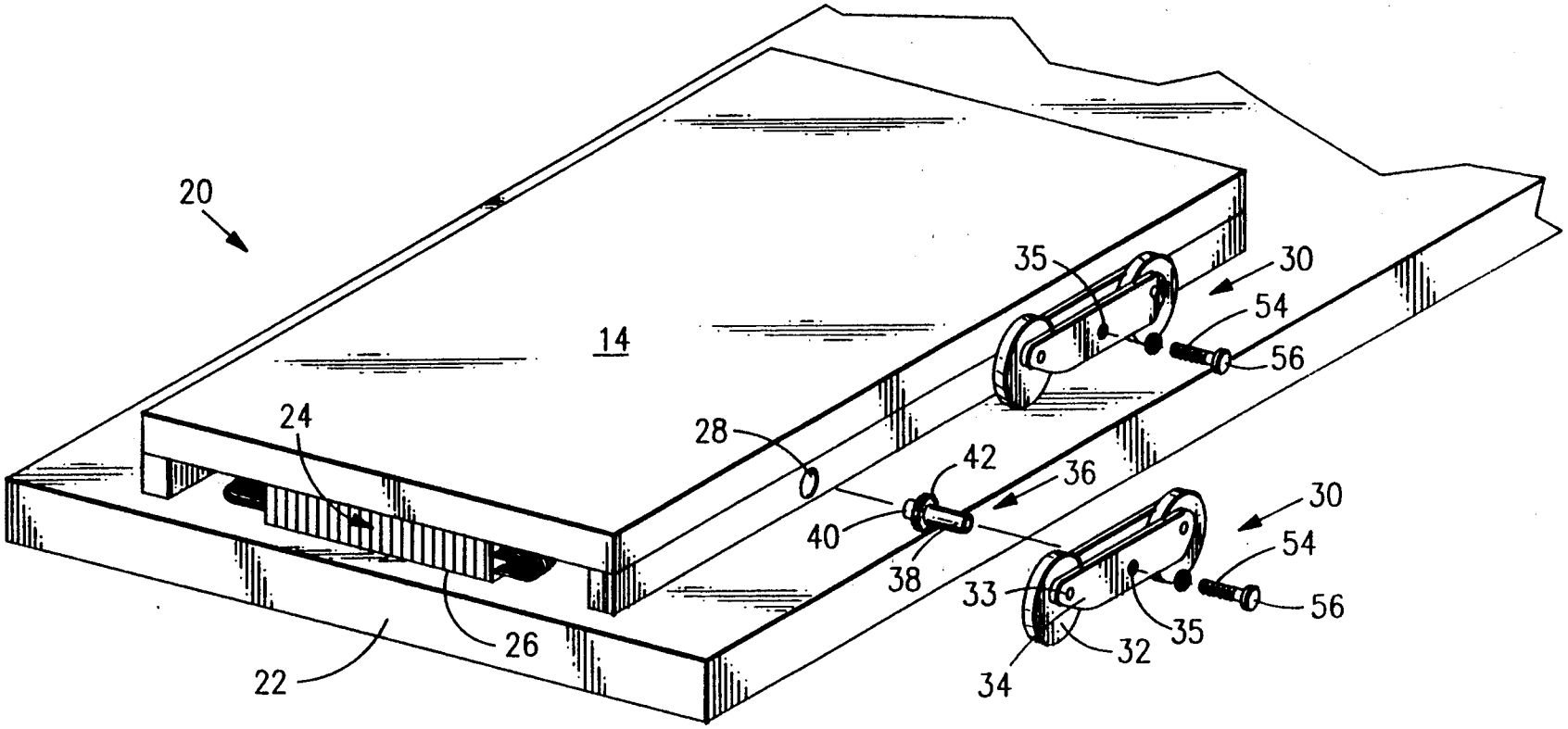
FIG. 2 is a top perspective view of the linear motor of FIG. 1 in accordance with the present invention.
Figure 4:
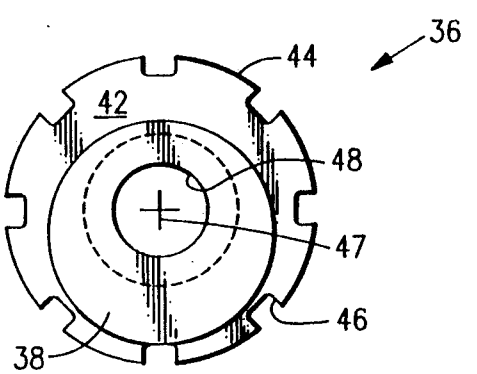
Figure 5:
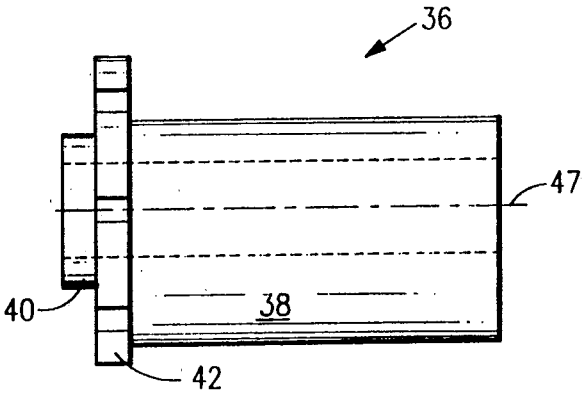
Figure 1:
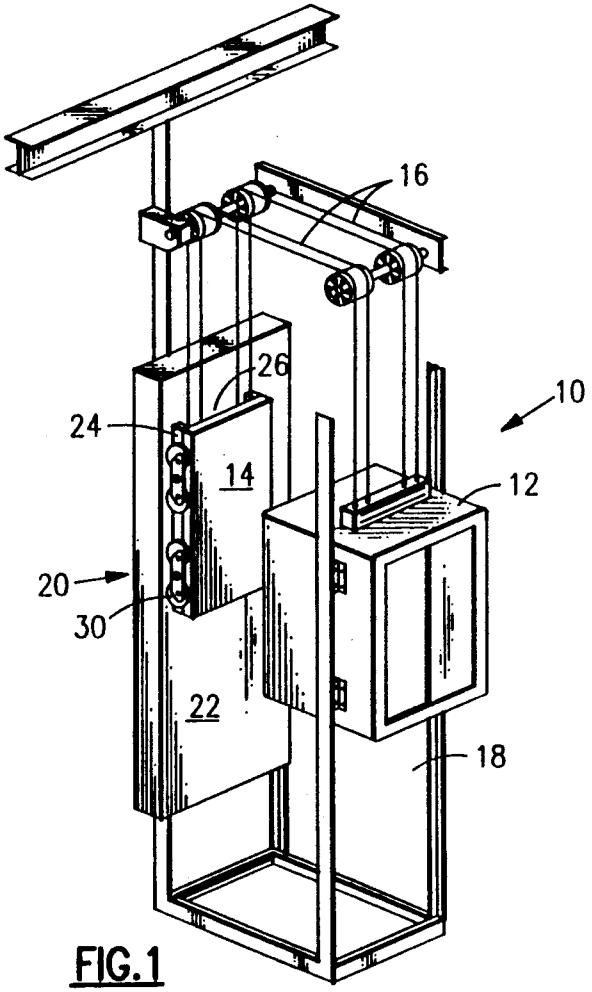

An elevator system 10 shown in FIG. 1 comprises an elevator car 12 and a counter weight 14, each suspended on opposite ends of a hoist rope 16 disposed in an elevator hoistway 18. The elevator system 10 also includes a linear motor 20 (as seen in FIG. 2), which comprises two portions, one stationary 22 and one moving 24. As is known in the art, the stationary portion 22 can be either a stator or a rotor and the moving portion 24 can be either a rotor or a stator, respectively The stationary element 22 is disposed on an inside wall of the hoistway 18 extending throughout the length thereof, whereas the moving element 24 is fixedly attached to the counter weight 14, so that the moving element 24 disposed opposite of the stationary element 22 forms an air gap 26 therebetween. A slot aperture 28, as best seen in FIG. 2, is formed within a side of the moving element 24. The linear motor 20 further comprises a set of roller trucks 30 attached to the moving element 24 of the linear motor 20.

Figure 4:
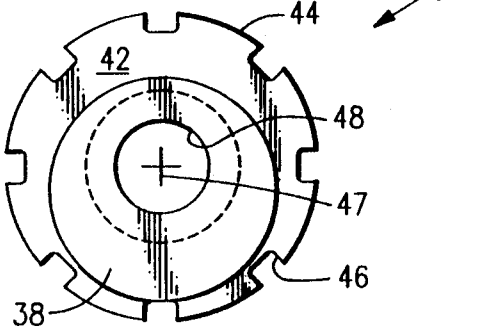
FIG. 4 is a top view of the roller cam adjuster of FIG. 3.
Figure 5:
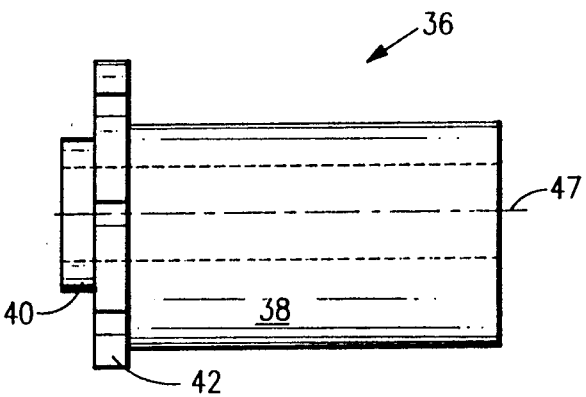
FIG. 5 is a side view of the roller cam adjuster of FIG. 3.

Referring to FIG. 2, each roller truck 30 comprises a plurality of rollers 32 supported by axles 33 held between two metal plates 34 on both sides so that the rollers are free to rotate therein A pivot slot 35 is formed within each metal plate 34. The roller truck further includes an adjustable roller cam 36 comprising a shaft 38, a stub 40, and a collar 42 sandwiched between the shaft and the stub, as shown in FIGS. 3–5. The collar 42 has a disk-like shape and an outer surface 44 wherein notches 46 are formed, equidistant from each other. The shaft 38, has a cylindrical body attached to the collar 42 on one end thereof in an offset relationship with a central axis 47. The stub 40, having a disk-like body, is attached to the other side of the collar 42, thus sandwiching the collar between the stub 40 and the shaft 38.

A through hole bore 48 extends through the shaft 38, the collar 42, and the stub 40. The bore 48 is disposed within the shaft at an offset centerline to achieve cam motion The collar and the stub share the same central axis 47 with the bore 48.

In assembly, the stub 40 fits into the slot aperture 28, as best seen in FIG. 2, whereas the shaft 38 fits into each pivot slot 35 of the roller truck 30, with the collar 42 remaining to be disposed between the moving element 24 and the roller truck 30. A washer 54 is placed onto the shaft to keep the roller truck in place and a bolt 56 is tightened to secure the assembly.

In operation, referring to FIG. 1, the elevator car 12 and the counter weight 14 alternatingly move in a vertical direction as the linear motor 20 begins to operate. The linear motor provides linear motion to the counter weight and accordingly to the elevator car. As the air gap 26 requires adjustment, the roller cam adjuster 36 is adjusted so that the air gap 26 is either increased or decreased. To achieve adjustment, a spanner wrench (not shown) is used to turn the cam adjuster 36 by placing the wrench into the notches 46 and rotating the cam adjuster 36 a proper amount to achieve the necessary adjustment. As the collar 42 is rotated, the stub 40 rotates with the collar without any displacement with respect to the collar since the stub and the collar are concentric. The shaft 38 also rotates with displacement of the collar, but due to its offset position, the shaft follows a different displacement path. Thus, the shaft displaces the roller truck 30 disposed thereupon with respect to the collar 42 and therefore with respect to the stationary portion 22 of the linear motor 20. Depending on the amount of rotation, the roller truck 30 can be adjusted either away from or toward the stationary portion 22, thus either increasing or decreasing the air gap 26.

Another embodiment of the present invention, as depicted in FIG. 6, comprises a similar cam adjuster 36 having opposing flat surfaces 60 on the collar surface 44 instead of the notches 46 as in FIG. 3. A thin open end wrench (not shown) can be utilized to adjust the roller cam adjuster 36.

While the present invention has been illustrated and described with respect to a particularly preferred embodiment thereof, it will be appreciated by those of ordinary skill in the art, that various modifications to this invention may be made without departing from the spirit and scope of the present invention.

We claim:

1. An elevator linear motor, comprising:

a stationary element, a moving element separated from said stationary element by an air gap, said moving element having an aperture disposed on a side thereof, and an adjusting means for maintaining and adjusting said air gap between said stationary element and said moving element comprising;

a roller, a plate having a pivot opening disposed therein and means for rotatably supporting said roller, a cam for adjusting said air gap, said cam fitting into said aperture of said moving element on one side and into said pivot opening formed within said metal plate so that position of said stationary element in relation to said moving element can be adjusted by adjusting said cam and said plate pivoting about said cam, and a fastening means to secure said plate onto said moving element.

2. The linear motor of claim 1 wherein said cam further comprises:

a collar having a disk-like body with two sides and notches equidistant from each other and disposed at a radial surface of said collar;

a stub attached to one side of said disk-like body of said collar, and a shaft having a cylindrical body and two ends, said one end attached to said other side of said collar in an offset manner, thereby sandwiching said collar between said shaft and said stub.

3. The linear motor of claim 2 further comprising:

a bore extending through said shaft, said collar, and said stub, wherein said bore is disposed at an offset from said shaft of said cam and is coaxial with said collar and said stub.

* * * * *